US005954972A

United States Patent [19]

Polimeni, Jr.

[11] Patent Number: 5,954,972

[45] Date of Patent: Sep. 21, 1999

[54] METHOD OF CLEANING A POOL

[75] Inventor: Ralph F. Polimeni, Jr., Reno, Nev.

[73] Assignee: The Gadgeteers Inc., Sparks, Nev.

[21] Appl. No.: 09/190,877

[22] Filed: Nov. 12, 1998

Related U.S. Application Data

[62] Division of application No. 09/075,570, May 11, 1998.

[51] Int. Cl.[6] ..... E04H 3/16

[52] U.S. Cl. ..... 210/744; 210/780; 210/806; 210/169

[58] Field of Search ..... 210/122, 744, 210/776, 780, 783, 806, 169, 242.1, 387, 400, 416.2, 525; 4/496; 417/61

[56] References Cited

U.S. PATENT DOCUMENTS

| | | |
|---|---|---|
| 1,920,371 | 8/1933 | Franke . |
| 2,646,889 | 7/1953 | Dulak . |
| 2,664,203 | 12/1953 | Crane et al. . |
| 3,012,676 | 12/1961 | Englesberg . |
| 3,273,507 | 9/1966 | Handford . |
| 3,397,647 | 8/1968 | Daniel . |
| 3,412,862 | 11/1968 | Chaplin . |
| 3,416,176 | 12/1968 | Ravitts . |
| 3,470,822 | 10/1969 | Evans et al. . |
| 3,581,896 | 6/1971 | Kuhlman . |
| 3,612,721 | 10/1971 | Evans et al. . |
| 4,154,680 | 5/1979 | Sommer . |
| 4,240,174 | 12/1980 | Thiem et al. . |
| 4,282,095 | 8/1981 | Tsuhako . |
| 4,485,013 | 11/1984 | Cockman . |
| 4,553,902 | 11/1985 | Eberhardt . |
| 4,581,075 | 4/1986 | St. Martin . |
| 4,654,141 | 3/1987 | Frentzel . |
| 4,746,424 | 5/1988 | Drew . |
| 4,836,920 | 6/1989 | Miller, Jr. . |
| 4,839,063 | 6/1989 | Brooks . |
| 4,867,873 | 9/1989 | Akazawa . |
| 4,880,531 | 11/1989 | Blake et al. . |
| 4,889,622 | 12/1989 | Newcombe-Bond . |
| 4,900,432 | 2/1990 | Arnold et al. . |
| 5,106,492 | 4/1992 | Distinti et al. . |
| 5,143,605 | 9/1992 | Masciarelli . |
| 5,350,508 | 9/1994 | Van der Watt . |
| 5,450,644 | 9/1995 | Berman . |
| 5,536,397 | 7/1996 | D'Offay . |
| 5,624,238 | 4/1997 | Herbert . |

*Primary Examiner*—Jay H. Woo
*Assistant Examiner*—Fred Prince
*Attorney, Agent, or Firm*—William H. Eilberg

[57] ABSTRACT

A pool cleaner floats on the surface of a pool. The cleaner includes a pump and filter, the filter being connected downstream of the pump. A vacuum head, connected by a hose to the pump, is moved around the pool, to direct water from the pool through the pump and filter. Due to the absence of any filter on the upstream side of the pump, the cleaner maintains its efficiency for a longer time than comparable cleaners of the prior art. The cleaner may also include a rotary strainer, placed upstream of the pump, for removing large pieces of debris. The strainer includes a slidable, transparent access cover which allows visual monitoring of the condition of the strainer, and permits easy access to the interior of the strainer, for removal of debris. In another embodiment, the cleaner includes a filter unit having a continuous sheet of filter material which advances automatically when the filter material previously exposed to the water has become clogged. The cleaner therefore substantially speeds the process of cleaning a pool.

5 Claims, 6 Drawing Sheets

METHOD OF CLEANING A POOL

This is a division of application Ser. No. 09/075,570, filed May 11, 1998.

BACKGROUND OF THE INVENTION

The present invention relates to the field of maintenance of swimming pools and the like, and provides a simple, reliable, and efficient cleaning device for such pools.

Vacuum cleaners for swimming pools have been known, as exemplified by the cleaning device shown in U.S. Pat. No. 4,581,075. The latter patent, the disclosure of which is hereby incorporated by reference herein, describes a cleaner having a pump and filter assembly which floats on the surface of a pool, while a vacuum head is moved around the pool to clean it. The flow of water produced by the pump also provides a propulsion force to drive the cleaner around the pool.

Pool cleaners such as that shown in the above-cited patent, and other similar pool cleaners of the prior art, have the disadvantage that they require filters disposed upstream of the pump. Positioning the filter ahead of the pump degrades the performance of the cleaner because the pressure exerted by the water in the pool is inherently limited, and as the filter fills with debris, it becomes increasingly difficult to push water through the system. It then becomes necessary to reduce the height of the vacuum head, relative to the bottom of the pool, so as to maintain efficiency of operation. As the filter fills even more, it becomes increasingly difficult to maintain a desired throughput. The result is that, with pool cleaners of the prior art, it is generally necessary to make two or more passes through each area of the pool, because as the filter is somewhat clogged, the cleaner may be moving only half the flow of water that it did when the filter was fresh.

The present invention provides a pool cleaner which solves the above-described problem. The pool cleaner of the present invention substantially reduces the time and effort required to clean a pool. Moreover, in one embodiment, the present invention substantially automates the task of changing filters, thereby further reducing the time and effort required to clean a pool.

SUMMARY OF THE INVENTION

The pool cleaner of the present invention comprises a chassis which holds a pump and a motor to drive the pump. The chassis also holds one or more flotation devices, and a filter connected to the discharge hose of the pump. The pump has an intake port suitable for attachment to a hose which can be connected to a vacuum head. The vacuum head and hose can be manipulated throughout the pool, such that the debris in the pool is sucked into the hose, through the pump, and into the filter. The filter sits downstream of the pump, so that the incoming water does not pass through any filter before reaching the pump. The pool cleaner floats on the surface of the pool, and is pulled around the pool manually by the operator. The cleaner has no independent means of propulsion.

The filter may take the form of a basket which is mounted on the chassis, and connected to the discharge hose of the pump. Alternatively, the filter may comprise a filter unit which includes a continuous length of filter material, preferably arranged on rollers. The rollers are turned automatically when the filter material becomes clogged, thereby exposing fresh filter material to the incoming fluid stream, and thus effectively changing the filter.

In the preferred embodiment, the pool cleaner also includes a rotary strainer, connected in the fluid line leading to the intake port of the pump. The strainer traps relatively large debris that would harm the pump if allowed to pass into the cleaner. The strainer comprises a generally cylindrical body having a rotating impeller within the body. The impeller rotates under the influence of the incoming water which is drawn in by the pump. The strainer includes a retractable, transparent access cover, which enables the operator to see when debris is trapped within the strainer, and to reach and remove the debris easily.

The chassis includes a rack which can hold some or all of the length of the cleaning hose. The chassis has wheels which facilitate movement of the cleaner when it is not floating in a pool.

The present invention therefore has the primary object of providing a cleaner for swimming pools and the like.

The invention has the further object of providing a pool cleaner which is simple, relatively inexpensive, and reliable.

The invention has the further object of providing a pool cleaner in which incoming water does not pass through a filter before passing through a pump.

The invention has the further object of providing a pool cleaner which floats on the surface of a pool, and which does not have independent means of propulsion.

The invention has the further object of providing a pool cleaner whose throughput does not diminish as its filter becomes increasingly clogged.

The invention has the further object of providing a pool cleaner having a rotary strainer which permits easy inspection of its inside components, and which facilitates removal of debris.

The invention has the further object of providing a pool cleaner having a filter element which can be changed automatically when the filter becomes clogged.

The invention has the further object of substantially reducing the time and effort required to clean a pool.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
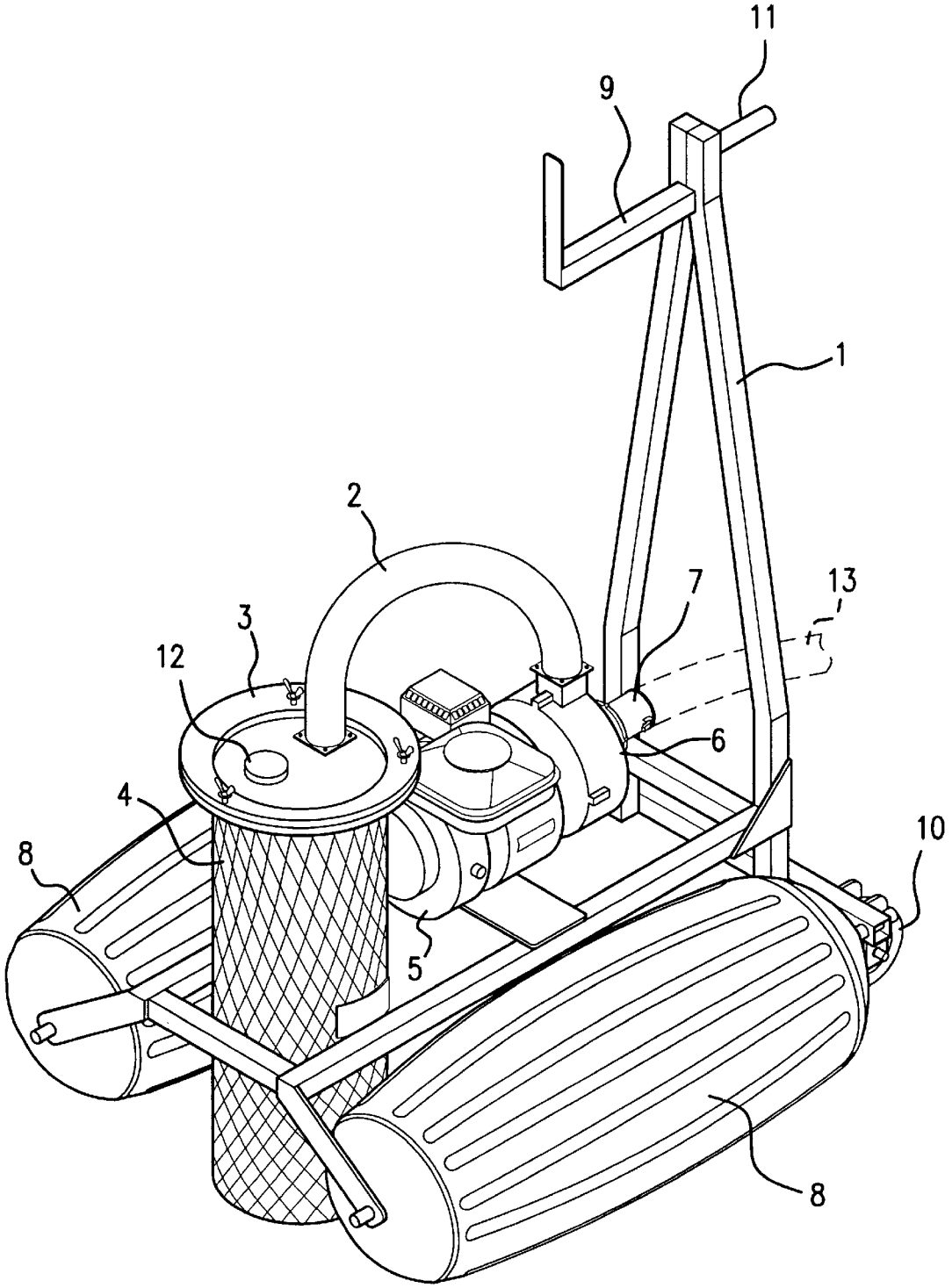
FIG. 1 provides a perspective view of the pool cleaner of the present invention.

FIG. 1 provides a perspective view of a first embodiment of the pool cleaner of the present invention. The pool cleaner includes a chassis 1 which supports a pair of floats 8, a pump 6, and a filter basket 4. The pump is driven by motor 5, which is preferably a gasoline engine. The pump includes an intake port 7, adapted to receive hose 13, shown in dotted outline, which hose can be connected to a vacuum head (not shown). The pump also has a discharge port which, in FIG. 1, is connected to discharge hose 2. The discharge hose directs water ejected by the pump into the filter basket.

The filter basket preferably includes a lid 3 and a pressure relief valve 12. The basket is attached to the chassis. The chassis also includes rack 9, which can support and store an excess length of hose (not shown), and handle 11, which facilitates positioning of the cleaner. The chassis includes wheels 10 (only one of which is visible in FIG. 1), to make it easy to transport the unit when it is not floating in a pool.

Figure 2:
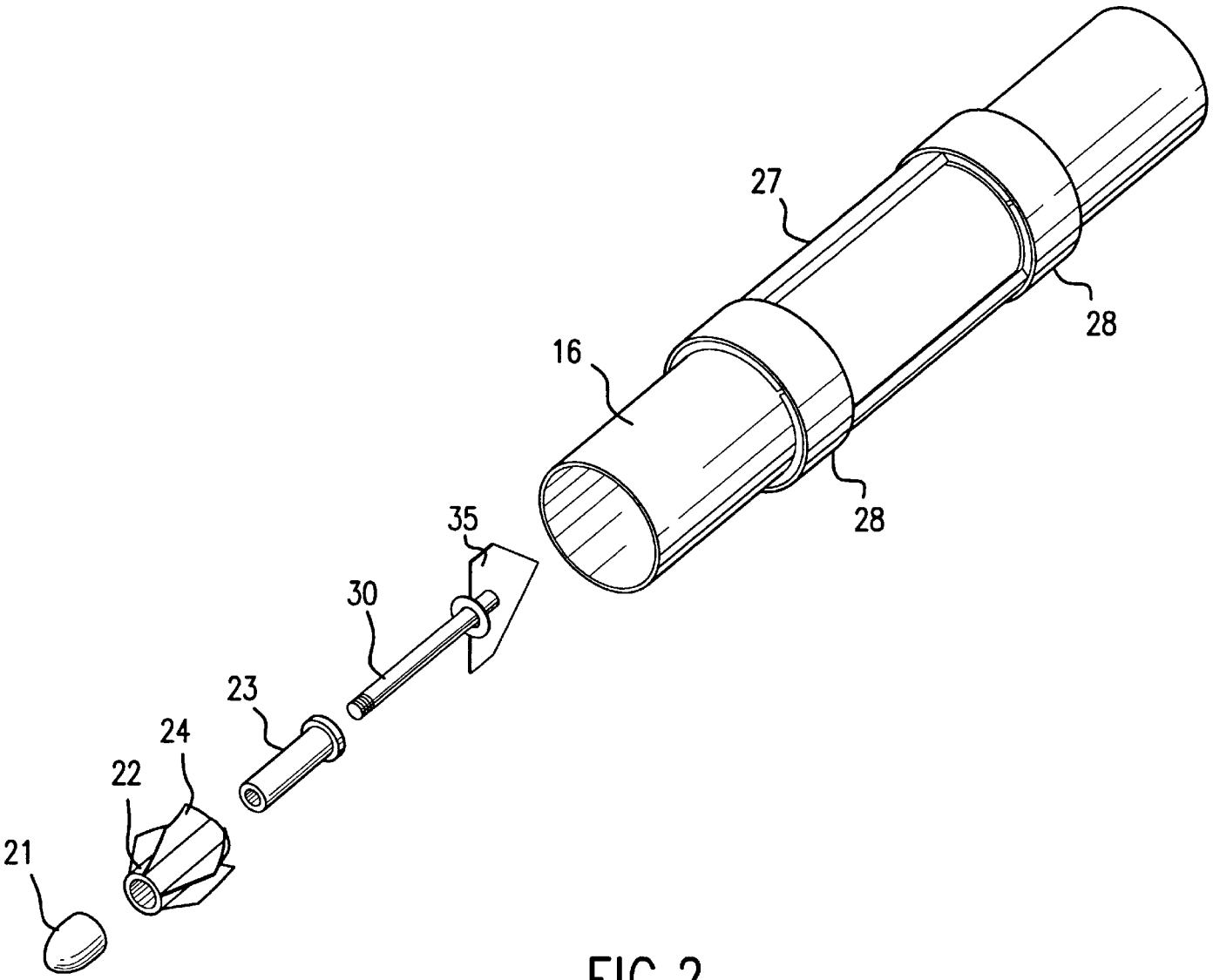
FIG. 2 provides a perspective view of the rotary strainer used in the pool cleaner of the present invention.
Figure 3:
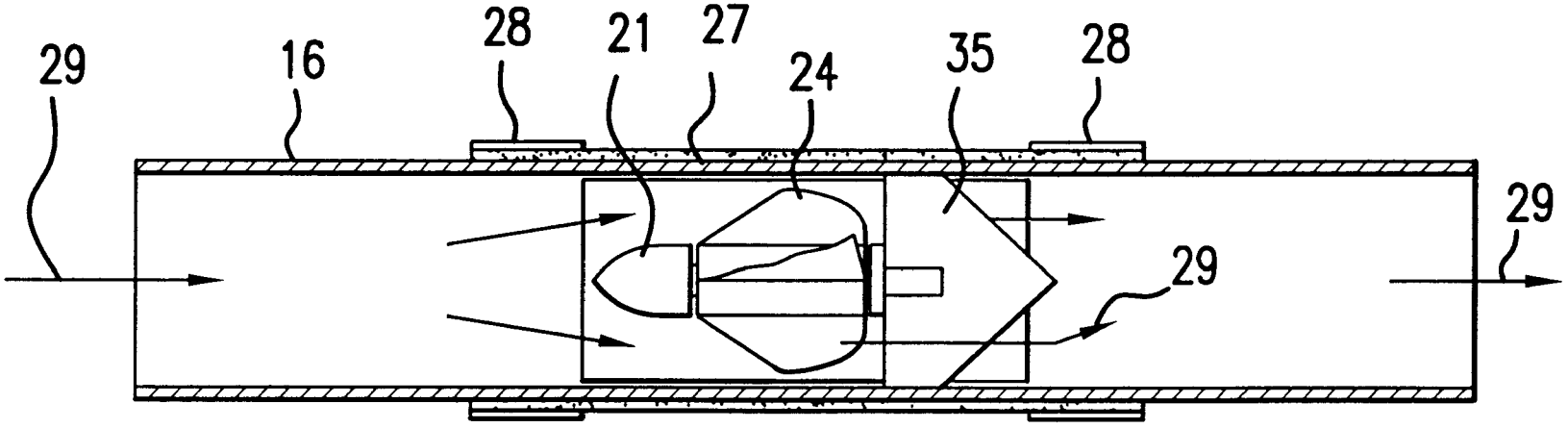
FIG. 3 provides a cross-sectional view showing the inside components of the rotary strainer of FIG. 2.

FIGS. 2 and 3 show a rotary strainer which is preferably used as part of the pool cleaner of the present invention. The rotary strainer comprises a generally cylindrical housing 16, and can be attached anywhere in a fluid line connected to intake port 7 of the pump 6. In the preferred embodiment, the housing is made of steel, but it could be formed of other materials, and the invention is not limited by the material used. Although the strainer could be attached directly to the intake port, it is preferred that the strainer be positioned farther away from the intake port, and near the operator of the pool cleaner, for reasons to be apparent from the description below. In the preferred embodiment, therefore, the rotary strainer may be separated from the pump and chassis by a relatively long length of hose.

The rotary strainer includes a rotating impeller 22 which has a plurality of outwardly-extending vanes 24 mounted around a cylindrical hub. The impeller is mounted over a bushing or bearing 23, which is preferably made of a plastic such as Teflon, and the latter assembly is mounted over shaft 30. The shaft is welded to shaft mount 35 which holds the shaft in place. A nose cone 21 is a nut which attaches to the impeller shaft, and provides smooth fluid flow over and around the impeller.

The housing of the rotary strainer also includes retractable access cover 27 which sits between the housing and pressure bands 28. The pressure bands are preferably made of an elastic material, such as rubber, and serve to hold the access cover onto the cylindrical housing. The cover 27 is preferably made of clear plastic, such as an acrylic. The cover defines a window through which an operator can determine visually whether any large debris is trapped in the strainer. Moreover, the cover slides or rotates so as to provide access to the interior of the strainer. Thus, any trapped debris can be periodically removed manually. The pressure bands assist in gripping the access cover; one can easily retract the access cover by moving the bands, which engage the access cover by friction, and cause the access cover to slide over the underlying housing material.

The diameter of the hub of the impeller is preferably chosen such that it allows a clearance of about 0.625 inches from the inner wall of the housing 16. This clearance will trap relatively large pieces of debris and prevent them from entering the pump. It has been found that the pump is not harmed by debris small enough to pass through the clearance.

The impeller turns under the influence of water that is moved through the unit, by the pump, in the direction shown by arrows 29. If a large piece of debris becomes trapped in the impeller, the impeller blades will stop turning. This condition is easily monitored visually, through the clear access cover 27, and can be easily corrected by sliding the access cover to expose the interior of the strainer, and then manually removing the debris. This is why it is preferred to position the strainer near the operator. With this arrangement, the operator can frequently monitor the condition of the impeller, and can take corrective action when necessary, without substantial effort.

The filter used in the embodiment of FIG. 1 is intended to be discarded when it is filled with debris. The filter can be easily replaced simply by inserting a new filter into the basket. The filter preferably has a capacity that is great enough to allow cleaning of a large pool without changing the filter. The pool cleaner itself therefore does not need to be cleaned; the major maintenance task is replacement of the filter.

In using the pool cleaner of the present invention, the operator connects a vacuum head (not shown in the drawings) to the pump. The vacuum head may be any vacuum head that is known in the prior art, as exemplified by the above-cited patent. The head itself forms no part of the present invention; the invention can be used with a wide variety of vacuum heads. Such a head would be attached to the pump by a hose, such as hose 13 shown in FIGS. 1 and 4, and, as mentioned above, this hose may also be connected to a rotary strainer so that the water passes through the strainer before reaching the pump. The operator may wade through the pool, while pulling the floating cleaner around the pool, and while manipulating the vacuum head to clean various regions of the pool. Alternatively, the operator could manipulate a relatively long vacuum head while standing outside the pool, to accomplish essentially the same result.

Figure 4:
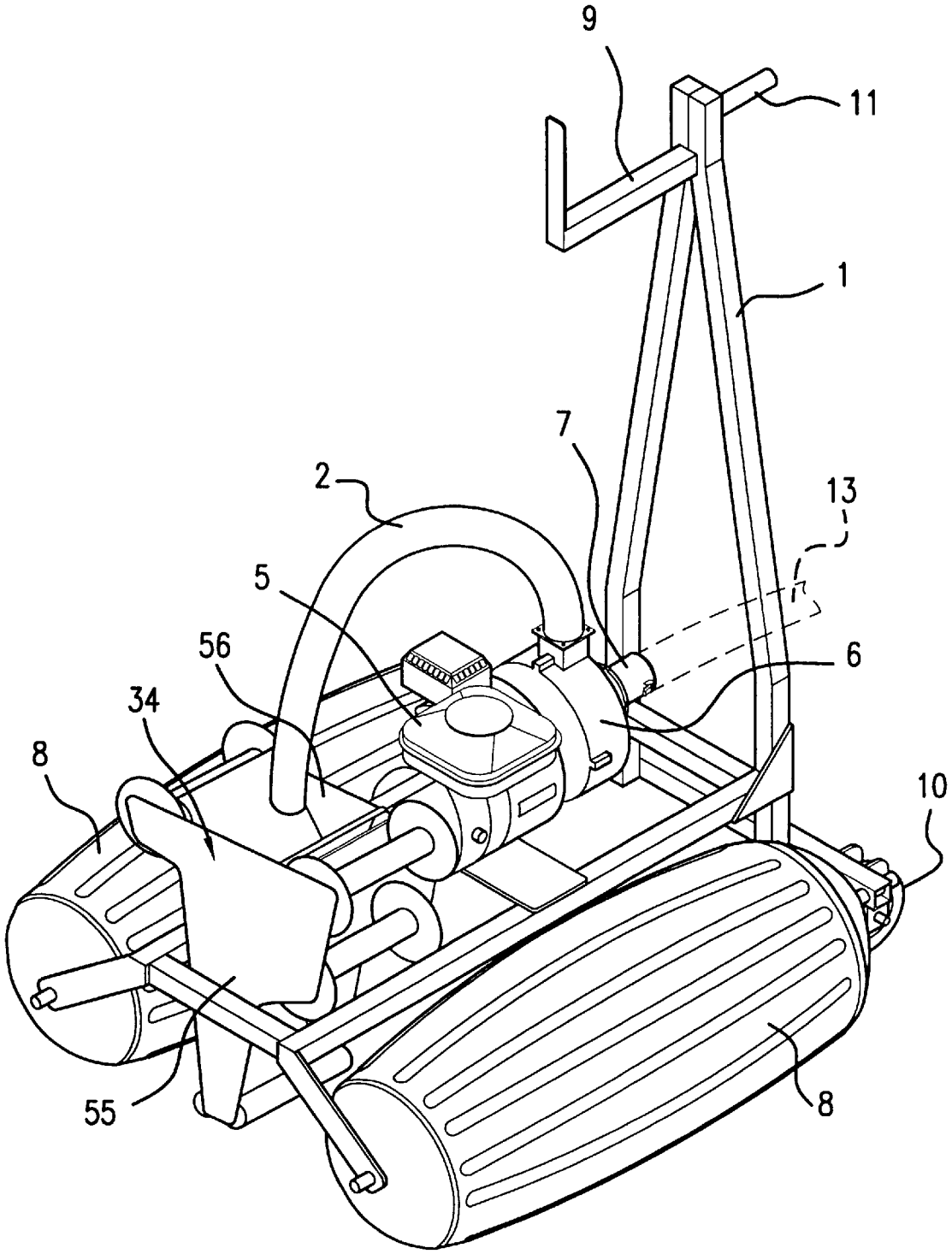
FIG. 4 provides a perspective view of an alternative embodiment of the pool cleaner of the present invention, this embodiment having a continuous filter element.

FIG. 4 provides a perspective view of another embodiment of the pool cleaner of the present invention. The only difference between the embodiment of FIG. 4 and that of FIG. 1 is in the filter unit. Therefore, except for the filter unit, all reference numerals in FIG. 4 are the same as those of FIG. 1, as they identify the same components. The filter unit of the embodiment of FIG. 4, designated by reference numeral 34, has a continuous filter material, illustrated more fully in FIGS. 5 and 6, and explained below.

The essence of the embodiment of FIG. 4 is that the filter material is provided in the form of one or more continuous rolls, such that changing the filter is accomplished by advancing the rolls. The changing of the filter is preferably done automatically, as will be described below.

Figure 5:
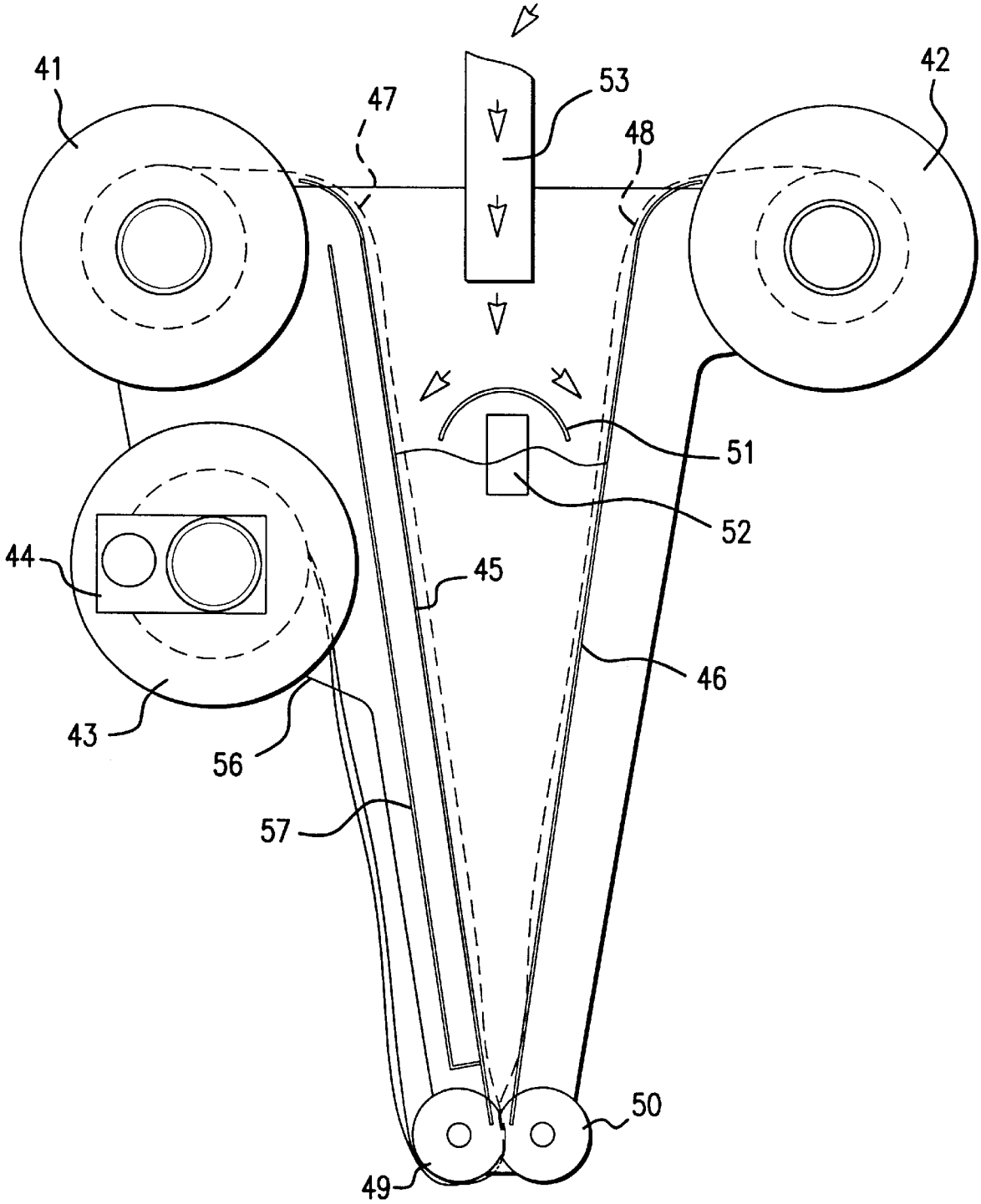
FIG. 5 provides a side elevational and partially diagrammatic illustration of the filter unit of the embodiment of FIG. 4.
Figure 6:
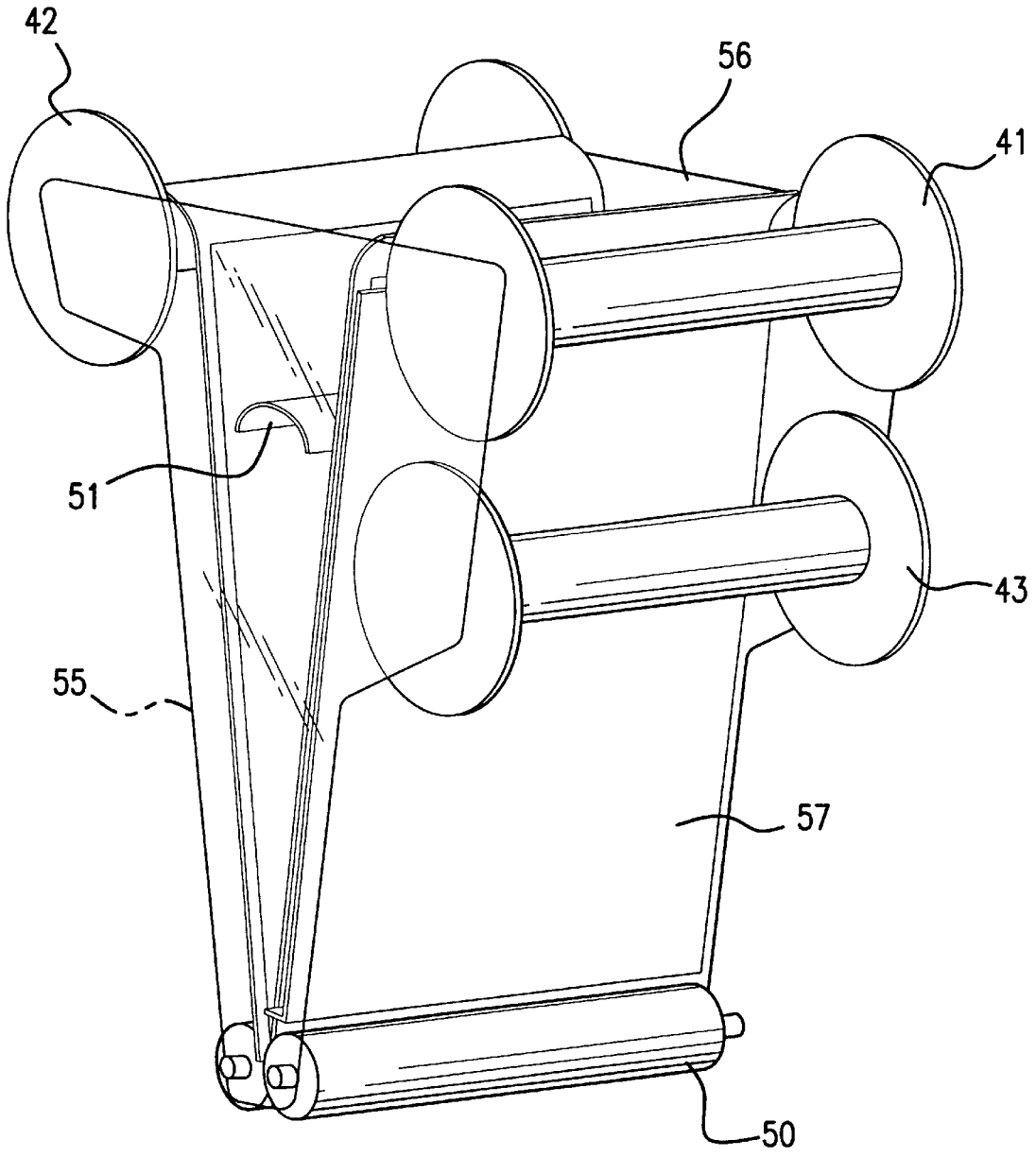
FIG. 6 provides a perspective view of the filter unit of the embodiment of FIG. 4.

As shown by FIGS. 5 and 6, the filter unit of the embodiment of FIG. 4 includes a plurality of rollers arranged such that the filter material forms a V-shaped enclosure. The filter unit includes feed rollers 41 and 42, disposed at the top ends of the "V", and take-up roller 43, located below feed roller 41. The take-up roller is positively driven by motor 44, which is preferably an electric motor. The take-up roller is the only roller that is driven; it pulls sheets of filter material through the apparatus, causing the feed rollers to rotate. The feed rollers 41 and 42 are therefore purely passive devices, rotating only due to the force exerted by the filter material being unwound from them.

The V-shaped structure is defined, in part, by a pair of mesh panels 45 and 46. These mesh panels support the movable sheets of filter material, while allowing fluid to flow through them and out of the filter unit. Sheets 47 and 48 of filter material are unwound, respectively, from rollers 41 and 42, and pass between soft rollers 49 and 50 before continuing towards the take-up roller. The soft rollers, which are preferably made of a foam material, squeeze the sheets together. For clarity of illustration, the sheets of material are shown with some slack and somewhat separated, in the region between the soft rollers and the take-up roller.

Water enters the filter unit through water inlet 53, which may be the same as pump discharge hose 2 of FIG. 4. Spray diffuser 51 directs the incoming water evenly around float switch 52, and helps to distribute the water equally to both sides of the "V". The float switch is connected to operate motor 44.

The filter unit also includes side walls 55 and 56, which are most clearly illustrated in FIGS. 4 and 6. For clarity of illustration, side wall 55 is shown in FIG. 6 to be made of transparent material, for the purpose of allowing the interior of the filter unit to be seen in this figure. For the same reason, side wall 56 is shown to be made of clear material in FIG. 5. The side walls could be transparent or opaque; what is important is that they are substantially impervious to water, so that all water inside the "V" of the filter unit is made to pass through the filter material.

The filter unit also includes shield 57 which prevents incoming fluid from impacting the spent and dirty filter material that has accumulated on take-up roller 43. Without the shield, water flowing onto the take-up roller would tend to dislodge debris from the spent filter material, returning that debris to the pool being cleaned, thus undermining the cleaning effort.

As the filter material gradually becomes clogged with debris, the incoming water takes longer and longer to pass through the filter. Eventually, water accumulates inside the filter, and the water level rises. When the filter material is sufficiently clogged, the water level in the filter will reach the vicinity of float switch 52, which is positioned at a predetermined height above the bottom of the "V". The float switch then activates motor 44, thereby pulling a quantity of filter material through the system, such that the clogged material is wound on the take-up roller, and fresh material is withdrawn from rollers 41 and 42. The motor is programmed so that it advances by just enough to remove the clogged filter material from the "V", and to provide fresh filter material in its place. The water then readily passes through the fresh material, and the motor is deactivated. In this way, the pool cleaner changes its filter automatically, without the intervention of an operator.

In the preferred embodiment, the float switch is positioned to be actuated when the filter unit is about three-quarters filled with water. The exact position of the float switch can be varied, within the scope of the invention.

In all other respects, the embodiment of FIG. 4 is operated in the same way as that of FIG. 1.

Both of the above embodiments substantially reduce the time and effort needed to clean a pool. Because the filter is located downstream of the pump, the cleaner maintains maximum efficiency even when the filter becomes clogged. Thus, it is seldom necessary to clean the same area of the pool twice. The cleaner floats on the pool, and can be easily pulled around the pool by the operator.

Although the invention has been described with respect to two preferred embodiments, further variations are possible. For example, one could omit the strainer, or vary its position in the fluid line leading to the intake port of the pump. Instead of two sheets of filter material, in the embodiment of FIGS. 4–6, one could have one sheet, or some other number. The configuration of rollers and drive motor(s) could also be varied, within the scope of the invention. One could drive different combinations of rollers, for example. The number of floats could be varied. These and other modifications, which will be apparent to the reader skilled in the art, should be considered within the spirit and scope of the following claims.

What is claimed is:

1. A method of cleaning a pool, the method comprising:

a) moving a floating cleaning apparatus along a surface of a pool, the cleaning apparatus having a chassis which houses a motor, a pump, and a filter unit, the filter unit comprising an enclosure defined by two opposing side walls and a continuous sheet of filter material disposed in a V-shape, wherein the V-shape defines an interior region and an exterior region of the filter unit, b) operating the pump to conduct water from the pool into the interior region of the filter unit, the operating step being performed while the apparatus is being moved along the surface of the pool, c) selecting a level of water in the interior region of the filter which level represents a maximum desired level, d) determining when water in the interior region of the filter unit reaches the maximum desired level selected in step (c), and e) advancing the filter material when the water in the interior region reaches the maximum desired level.

2. The method of claim 1, wherein step (b) includes diffusing the water as it enters the interior region of the filter unit.

3. The method of claim 1, wherein all steps of the method are performed while maintaining the V-shape of the filter material.

4. The method of claim 1, wherein step (b) includes the step of directing water from the pool through a rotary strainer before the water reaches the filter unit, the rotary strainer having means for viewing, and for gaining access to, an interior region of the strainer, wherein method further includes the step of viewing the interior region of the strainer.

5. The method of claim 1, wherein step (b) is performed such that water from the pool flows first to the pump and thereafter to the filter unit.

* * * * *